US011235447B2

(12) United States Patent
Shih

(10) Patent No.: US 11,235,447 B2
(45) Date of Patent: Feb. 1, 2022

(54) RATCHET WRENCH

(71) Applicant: Neng-Chia Shih, Changhua (TW)

(72) Inventor: Neng-Chia Shih, Changhua (TW)

( * ) Notice: Subject to any disclaimer, the term of this patent is extended or adjusted under 35 U.S.C. 154(b) by 202 days.

(21) Appl. No.: 16/773,207

(22) Filed: Jan. 27, 2020

(65) Prior Publication Data

US 2020/0269397 A1 Aug. 27, 2020

(30) Foreign Application Priority Data

Feb. 22, 2019 (TW) ..... 108106134

(51) Int. Cl.
*B25B 13/46* (2006.01)
*B25B 23/00* (2006.01)

(52) U.S. Cl.
CPC ..... *B25B 23/0035* (2013.01); *B25B 13/462* (2013.01)

(58) Field of Classification Search
CPC ... B25B 23/0035; B25B 13/462; B25B 13/04; B25B 13/463
USPC ..... 81/63, 63.1, 63.2
See application file for complete search history.

(56) References Cited

U.S. PATENT DOCUMENTS

2005/0044998 A1* 3/2005 Huang ..... B25B 13/463 81/63.2
2012/0210829 A1* 8/2012 Chang ..... B25B 13/463 81/63.2
2020/0406436 A1* 12/2020 Rosales ..... B25B 13/463

* cited by examiner

*Primary Examiner* — Joseph J Hail
*Assistant Examiner* — Shantese L McDonald
(74) *Attorney, Agent, or Firm* — Che-Yang Chen; Law Office of Michael Chen

(57) ABSTRACT

A ratchet wrench may include a main body and a quick release member. The main body has a driving end, and a tool hole vertically penetrates therethrough. A housing concavely formed on an inner wall of the tool hole, and a teeth section is installed in the housing. A ratchet wheel is installed into the tool hole, and an outer periphery of the ratchet wheel is adapted to engage with the teeth section so as to enable the ratchet wheel and the tool hole to have synchronous rotation. A driving hole axially penetrates through the ratchet wheel. The quick release member has a magnetic ring, a pressing member, and a cover. The pressing member is adapted to move relative to the driving hole and the magnetic ring, such that a sleeve can be easily coupled in or detected from the driving hole so as to achieve the quick release effect.

7 Claims, 11 Drawing Sheets

RATCHET WRENCH

FIELD OF THE INVENTION

The present invention relates to a ratchet wrench and more particularly to a quick release ratchet wrench.

BACKGROUND OF THE INVENTION

Referring to FIGS. 10 to 12, the conventional ratchet wrench comprises a main body (40) having a driving portion (41) at an end thereof, and an accommodating hole (411) is formed at a center portion of the driving portion (41), and an inner wall of the accommodating hole (411) is communicated with a housing (412) to place a driving block (42). A socket (43) is cooperated with two magnetic pieces (44) on an outer periphery thereof to engage with driving block (42) in the accommodating hole (412). Moreover, a driving hole (431) penetrating through a center of the socket (43) is adapted to engage with a nut, and the magnetic pieces (44) are configured to attract the nut, thereby preventing falling off from the socket (43).

However, the conventional ratchet wrench has following disadvantages: (i) although the magnetic pieces (44) can attract the nut, it also makes the socket (43) not easy to detach from the main body (40), which is inconvenient for use; and (ii) the magnetic pieces (44) need to be positioned before installed into the accommodating hole (411) of the main body (40), which increases the difficulty in assembly. Therefore, there remains a need for a new and improved design for a ratchet wrench to overcome the problems presented above.

SUMMARY OF THE INVENTION

The present invention provides a ratchet wrench which comprises a main body and a quick release member. The main body has a driving end, and a tool hole vertically penetrates through the driving end. A housing concavely formed on an inner periphery of the tool hole is communicated with the tool hole, and a teeth section is installed in the housing. A ratchet wheel is rotated and driven into the tool hole through an end thereof which is defined as an inner end of the ratchet wheel, and an outer periphery of the ratchet wheel is adapted to engage with the teeth section of the tool hole so as to enable the ratchet wheel and the tool hole to have synchronous rotation. A driving hole axially penetrates through the ratchet wheel. The quick release member has a magnetic ring, a pressing member, and a cover. The magnetic ring is coupled and magnetically attached to an outer end of the ratchet wheel. The pressing member is a column having the outer diameter smaller than the inner diameter of the magnetic ring, and a locating flange formed at a middle portion of an outer periphery of the pressing member has the outer diameter larger than the inner diameter of the magnetic ring, and the pressing member comprises a first pressing section and a second pressing section respectively formed at two sides of the locating flange. The first pressing section is adapted to pass through a center hole of the magnetic ring and insert into the driving hole of the ratchet wheel, and the locating flange is abutted against an outer end of the magnetic ring, and the second pressing section is configured to protrude out of the ratchet wheel. The cover has a through hole penetrating through a center portion thereof, and the cover is disposed on the second pressing section through the through hole, and the cover is configured to cover the magnetic ring and the pressing member and coupled on the outer end of the ratchet wheel.

In one embodiment, a locating edge is formed at an inner edge of an inner opening of the tool hole while a first annular groove is formed at an inner edge of an outer opening of the tool hole; the inner end of the ratchet wheel has a locating recess which is configured to engage with the locating edge of the tool hole, and the outer end of the ratchet wheel comprises a second annular groove which is cooperated with a C-shaped ring to engage with the first annular groove.

In another embodiment, the teeth section is connected to a pulling member which is adapted to drive and move the teeth section in the housing so as to adjust the engagement between the teeth section and the ratchet wheel when the tool hole is rotated in clockwise direction or counterclockwise direction.

In still another embodiment, a locating groove is formed at the outer end of the ratchet wheel, and the magnetic ring is positioned by engaging with the locating groove.

In a further embodiment, the magnetic ring is fixed with the ratchet wheel by glue.

In still a further embodiment, the cover is fixed with the outer end of the ratchet wheel by glue.

In a particular embodiment, an annular protruding portion is extended from an end of the cover, and a surface of an outer periphery of the annular protruding portion comprises a rough texture thereon.

Comparing with conventional ratchet wrench, the present invention is advantageous because: the main body is cooperated with a quick release member through the ratchet wheel, and the pressing member of the quick release member is adapted to move relative to the driving hole and the magnetic ring, such that the sleeve can be easily coupled in or detected from the driving hole so as to achieve the quick release effect.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
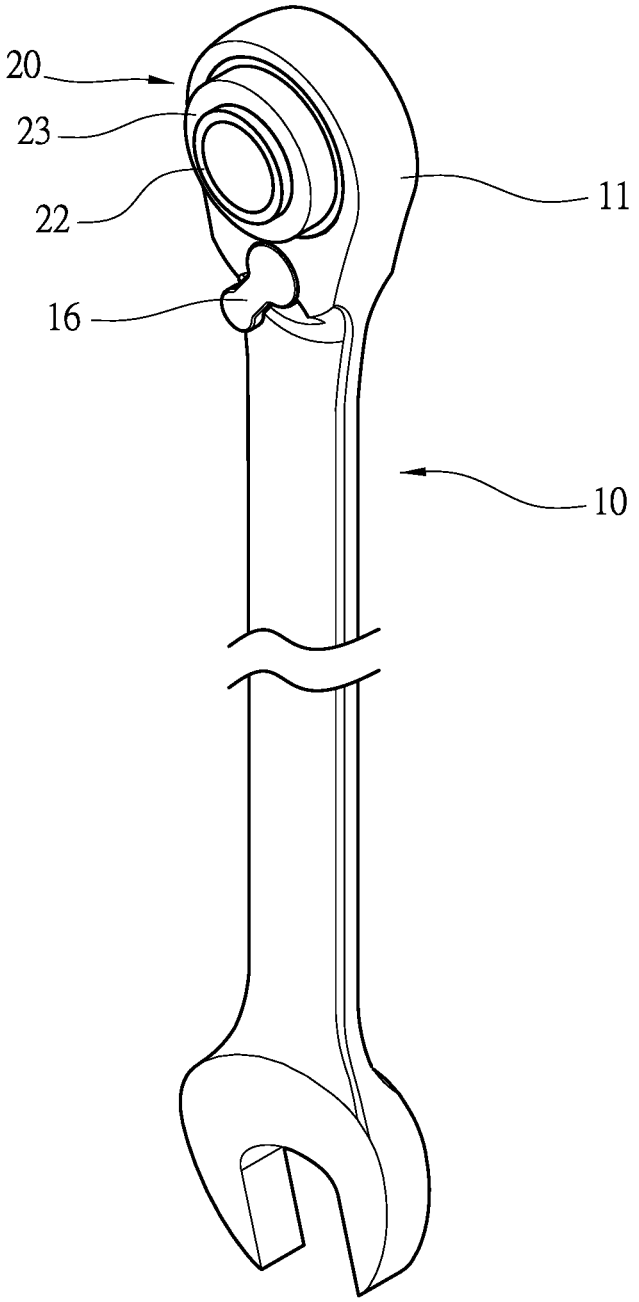
FIG. 1 is a three-dimensional assembly view of a ratchet wrench of the present invention.
Figure 2:
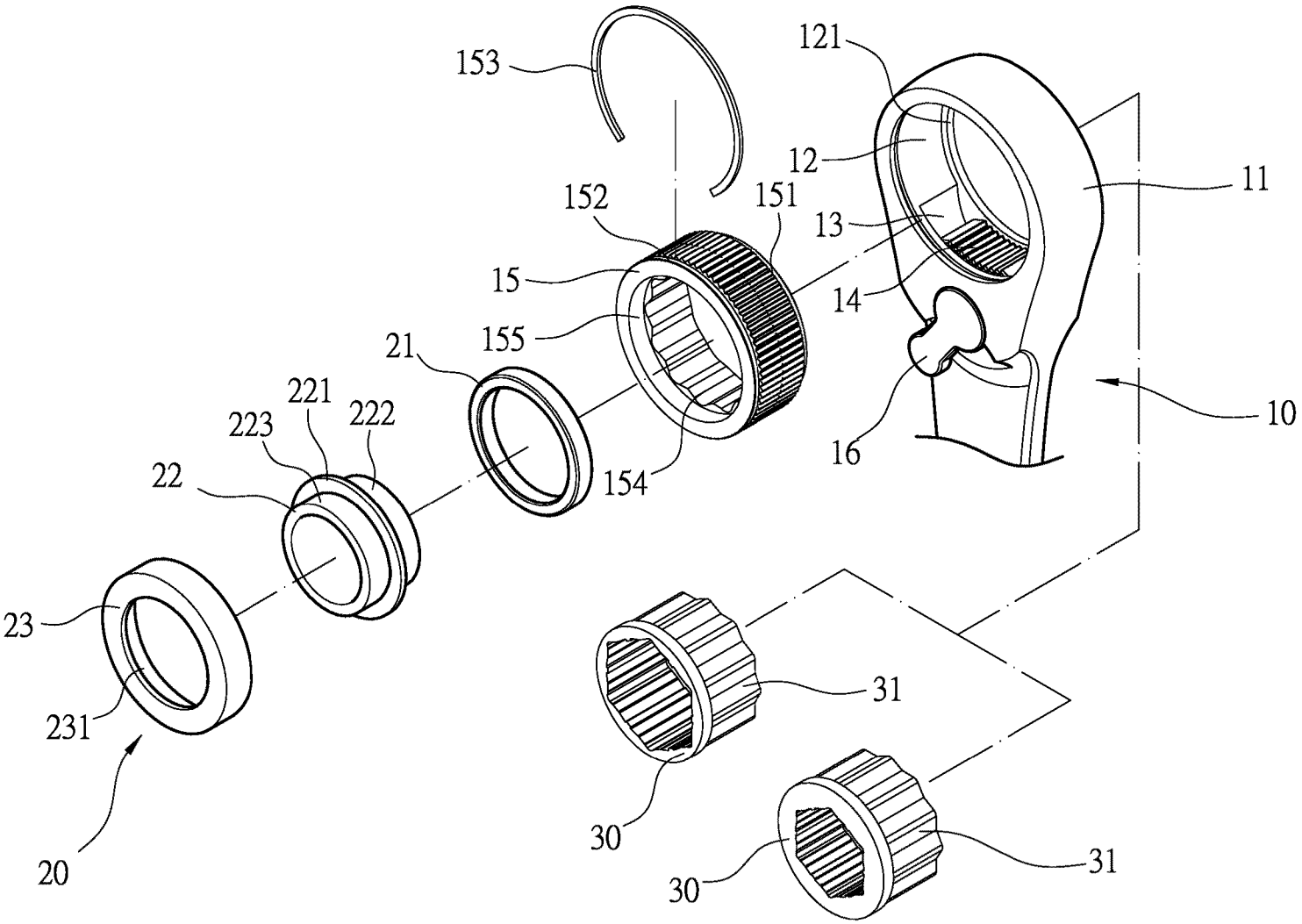
FIG. 2 is a three-dimensional exploded view of the ratchet wrench of the present invention.
Figure 3:
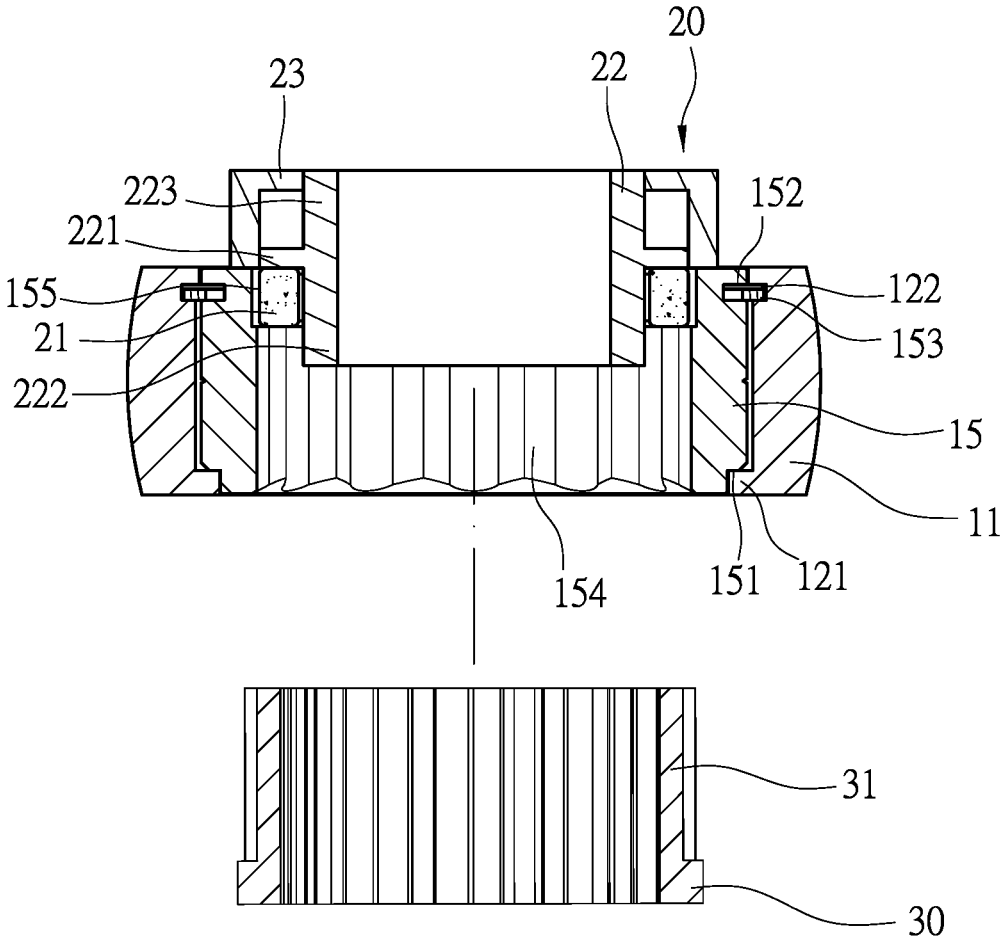
FIG. 3 is a sectional view illustrating a sleeve is coupled in a main body of the ratchet wrench in the present invention.
Figure 4:
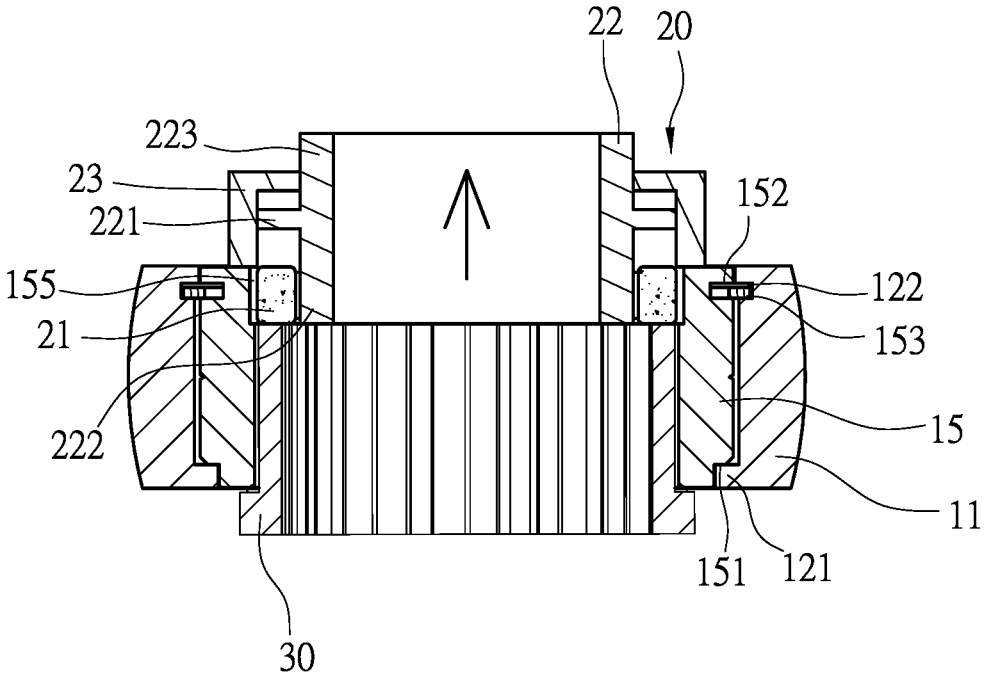
FIG. 4 is a sectional view illustrating the sleeve is magnetically attracted and secured by a magnetic ring of the ratchet wrench in the present invention.
Figure 5:
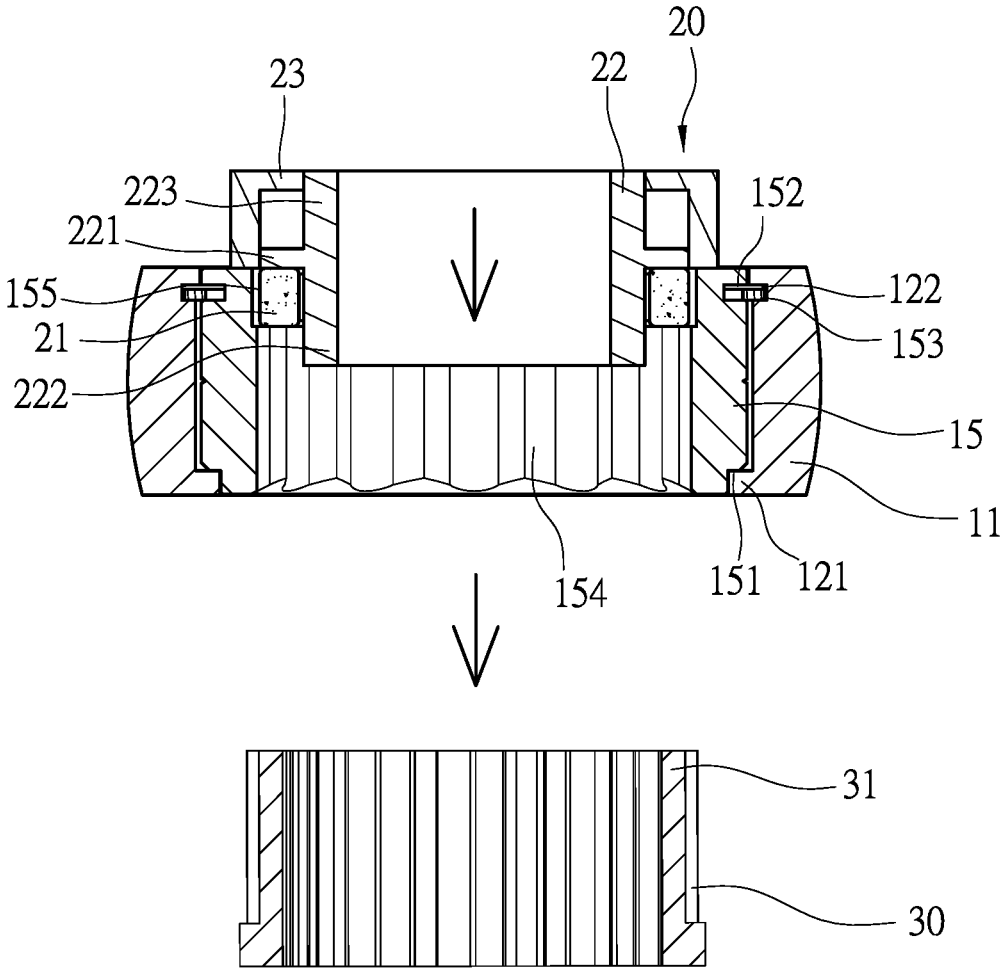
FIG. 5 is a sectional view illustrating a quick release member is pushed so as to detach the sleeve out from a driving hole of the ratchet wrench in the present invention.
Figure 6:
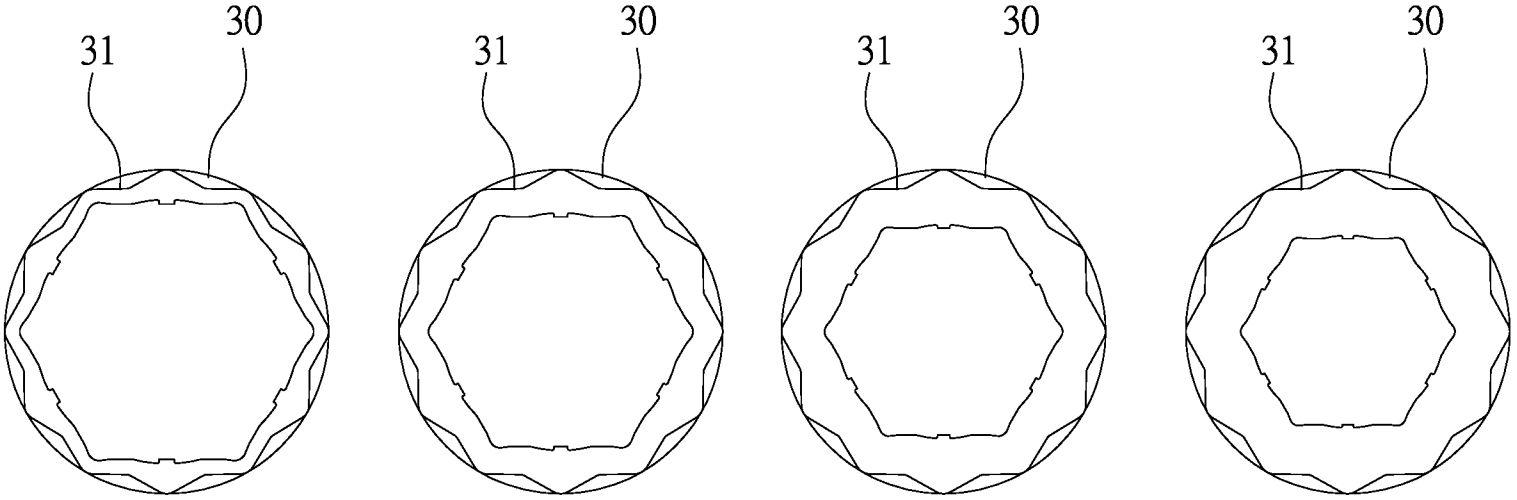
FIG. 6 is a sectional view illustrating different types of sleeves in the present invention.
Figure 7:
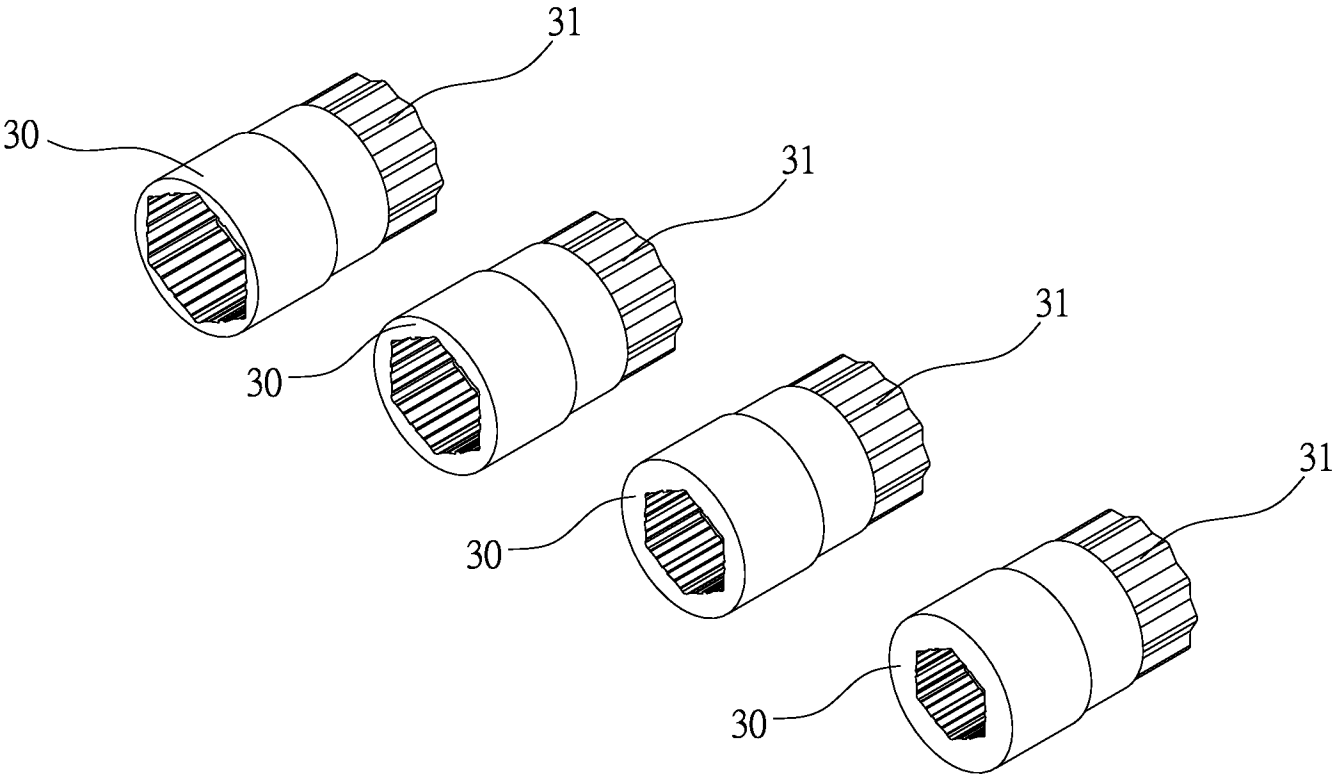
FIG. 7 is a three-dimensional view illustrating different types of sleeves in the present invention.

In order to further understand the goal, characteristics and effect of the present invention, a number of embodiments along with the drawings are illustrated as following:

Referring to FIGS. 1 to 3, the present invention provides a ratchet wrench which comprises a main body (10) and a quick release member (20). The main body (10) has a driving end (11), and a tool hole (12) vertically penetrates through the driving end (11). A locating edge (121) is formed at an inner edge of one opening of the tool hole (12), and a first annular groove (122) is formed at an inner edge of the tool hole (12) adjacent to the other opening thereof. Moreover, a housing (13) concavely formed on an inner periphery of the tool hole (12) is communicated with the tool hole (12), and a teeth section (14) is installed in the housing (13). Furthermore, a ratchet wheel (15) is rotated and driven into the tool hole (12) through an end thereof which is defined as an inner end of the ratchet wheel (15), and an outer periphery of the ratchet wheel (15) is adapted to engage with the teeth section (14) of the tool hole (12) so as to enable the ratchet wheel (15) and the tool hole (12) to have synchronous movement. In addition, the inner end of the ratchet wheel (15) has a locating recess (151) which is configured to engage with the locating edge (121) of the tool hole (12), and an outer end of the ratchet wheel (15) comprises a second annular groove (152) which is cooperated with a C-shaped ring (153) to engage with the first annular groove (122). The ratchet wheel (15) is engaged with the teeth section (14) to have synchronous rotation, and a driving hole (154) axially penetrates through the ratchet wheel (15). The quick release member (20) has a magnetic ring (21), a pressing member (22), and a cover (23). The magnetic ring (21) is coupled and magnetically attached to the outer end of the ratchet wheel (15) adjacent to the second annular groove (152). The pressing member (22) is a column having the outer diameter smaller than the inner diameter of the magnetic ring (21), and a locating flange (221) formed at a middle portion of an outer periphery of the pressing member (22) has the outer diameter larger than the inner diameter of the magnetic ring (21), and the pressing member (22) comprises a first pressing section (222) and a second pressing section (223) respectively formed at two sides of the locating flange (221). The first pressing section (222) is adapted to pass through a center hole of the magnetic ring (21) and insert into the driving hole (154) of the ratchet wheel (15), and the locating flange (221) is abutted against an outer end of the magnetic ring (21), and the second pressing section (223) is configured to protrude out of the ratchet wheel (15). The cover (23) has a through hole (231) penetrating through a center portion thereof, and the cover (23) is disposed on the second pressing section (223) through the through hole (231). Also, the cover (23) is configured to cover the magnetic ring (21) and the pressing member (22) and coupled on the outer end of the ratchet wheel (15).

In one embodiment, the teeth section (14) is connected to a pulling member (16) which is adapted to drive and move the teeth section (14) in the housing (13) so as to adjust the engagement between the teeth section (14) and the ratchet wheel (15) when the tool hole (12) is rotated in clockwise direction or counterclockwise direction.

In another embodiment, a locating groove (155) is formed at the outer end of the ratchet wheel (15), and the magnetic ring (21) is positioned by engaging with the locating groove (155).

In still another embodiment, the magnetic ring (21) is fixed with the ratchet wheel (15) by glue.

In a further embodiment, the cover (23) is fixed with the outer end of the ratchet wheel (15) by glue.

Structurally, referring to FIGS. 1 to 3, the teeth section (14) is installed in the housing (13), and the ratchet wheel (15) is installed in the tool hole (12) to engage with the teeth section (14). Furthermore, the locating recess (151) of the ratchet wheel (15) is engaged with the locating edges (121) of the tool hole (12) so as to secure the position of the ratchet wheel (15) in the tool hole (12). Also, the C-shaped ring (153) is coupled on the second annular groove (152), and the C-shaped ring (153), which is resilient, is engaged and positioned in the first annular groove (122) in the housing (13). In addition, the magnetic ring (21) of the quick release member (20) is attached on the outer end of the ratchet wheel (15), and the center hole of the magnetic ring (21) is communicated with the driving hole (154) of the ratchet wheel (15). The first pressing section (222) of the pressing member (22) is configured to pass through the center hole of the magnetic ring (21), and the locating flange (221) of the pressing member (22) is abutted against the outer end of the magnetic ring (21), and the first pressing section (222) is inserted into the driving hole (154) of the ratchet wheel (15). The through hole (231) of the cover (23) is disposed on the second pressing section (223) of the pressing member (22), and the cover (23) is secured on the outer end of the ratchet wheel (15) by glue.

In actual application, referring to FIGS. 3 to 7, the driving hole (154) of the ratchet wheel (15) in the tool hole (12) of the main body (10) is disposed on and lock and unlock a lock unit, and one of different sleeves (30) can be fitted into the driving hole (154) from an end of the main body (10) other than the cover (23) for torsion operation. The sleeve (30) comprises an engaging section (31) to engage in the driving hole (154) so as to complete the installation of the sleeve (30) in the driving hole (154). Moreover, the outer diameter of the first pressing section (222) of the pressing member (22) is smaller than the inner diameter of the driving hole (154), such that when the sleeve (30) is inserted into the driving hole (154), the sleeve (30) is adapted to abut against the first pressing section (222) first. Thereafter, when the sleeve (30) is pressed into the tool hole (12), the pressing member (22) is pushed by the sleeve (30) toward the cover (23), and the first pressing section (222) is moved outwardly so that the sleeve (30) is attracted and positioned by the magnetic ring (21). On the other hand, when the sleeve (30)

needs to be detached from the driving hole (154), since the pressing member (22) is pushed outwardly by the sleeve (30), a gap is formed between the locating flange (221) and the ratchet wheel (15). As a result, when the second pressing section (223) of the pressing member (22) is pressed inwardly, the sleeve (30) is pushed by the pressing member (22) so as to detach from the magnetic ring (21). Additionally, the power generated by the press of the pressing member (22) is configured to direct detach the sleeve (30) from the driving hole (154) so as to achieve the quick release effect.

Figure 8:
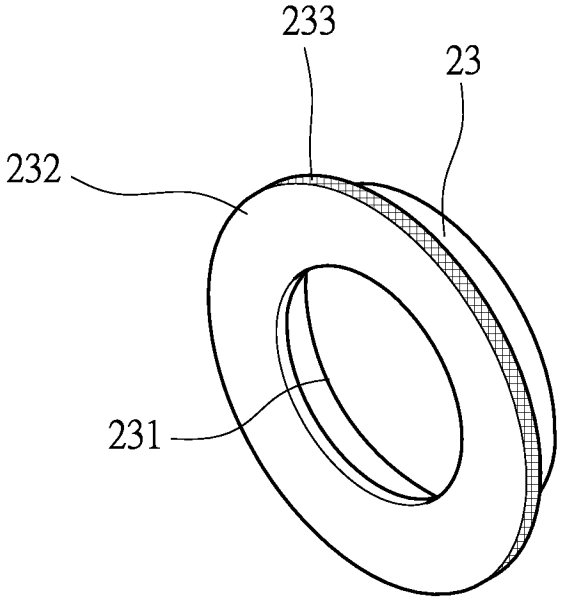
FIG. 8 is a three-dimensional view of another embodiment of a cover of the ratchet wrench in the present invention.
Figure 9:
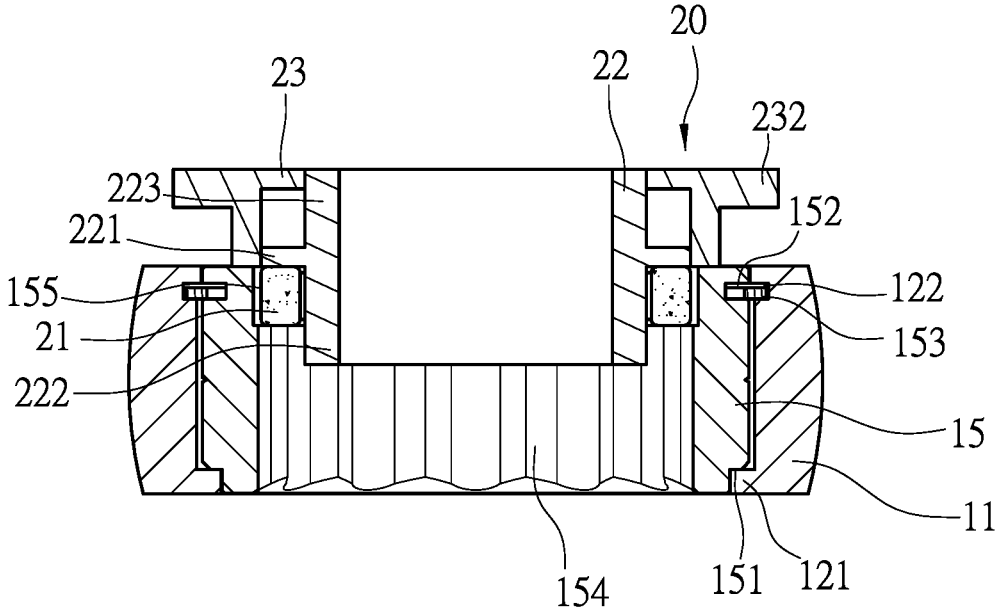
FIG. 9 is a sectional assembly view of FIG. 8.
Figure 10:
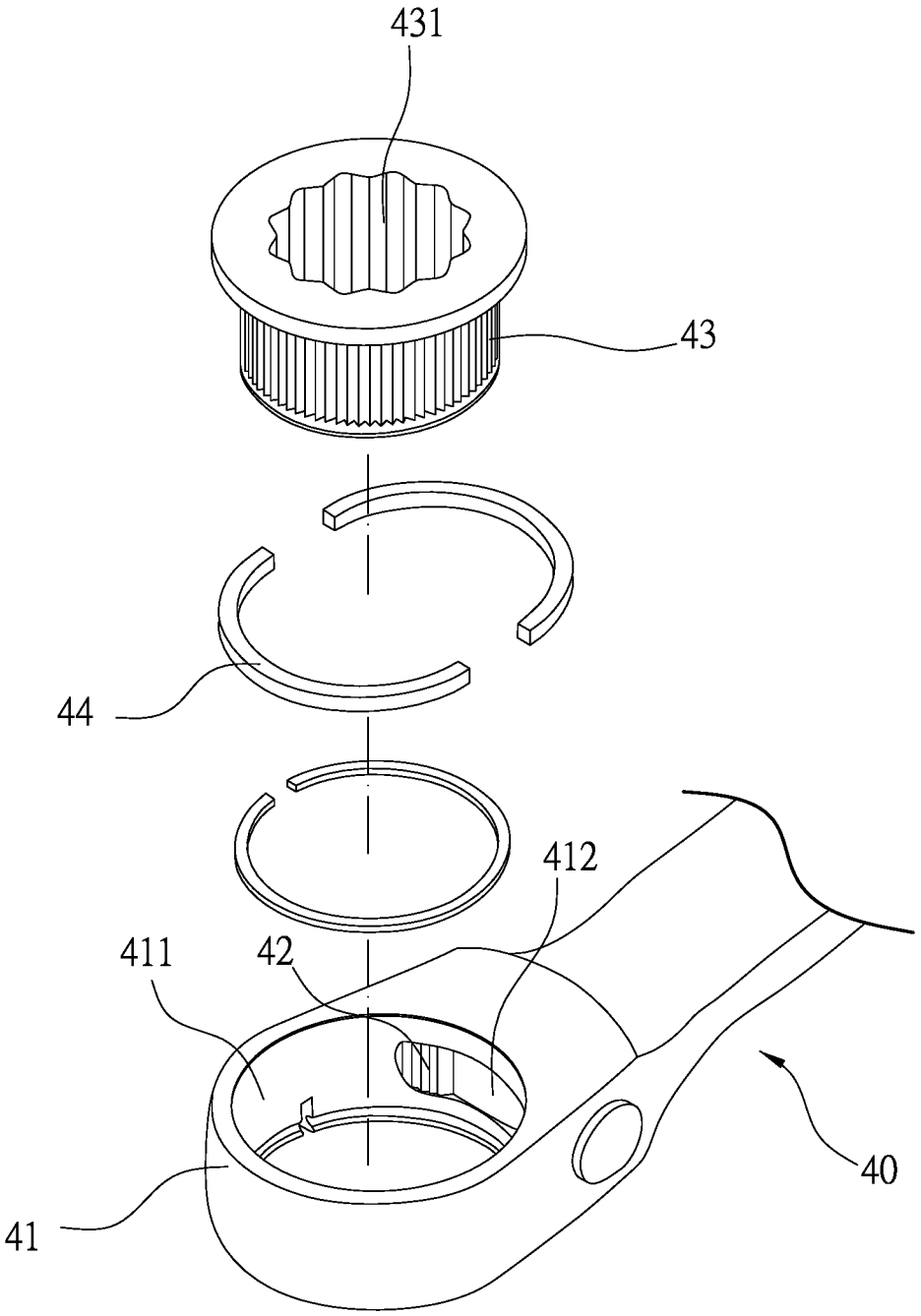
FIG. 10 PRIOR ART
FIG. 10 is a prior art.
Figure 11:
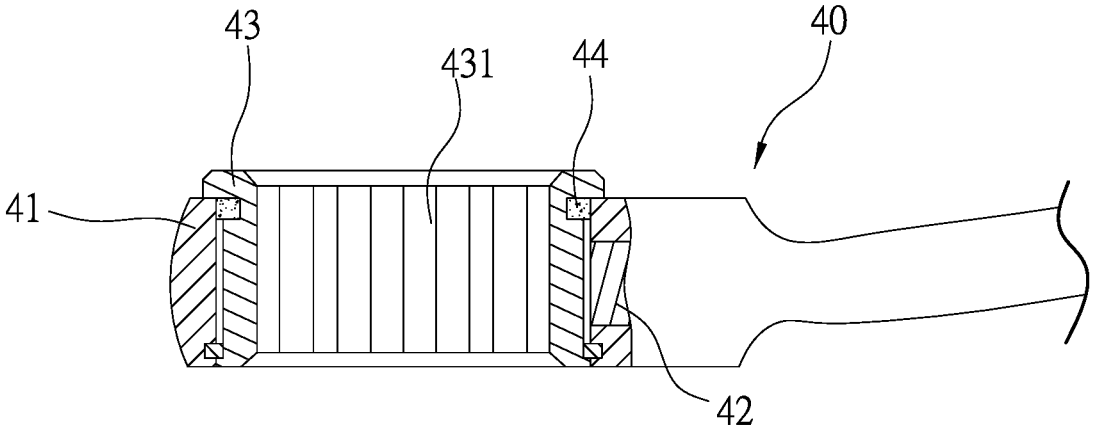
FIG. 11 PRIOR ART
FIG. 11 is a prior art.
Figure 12:
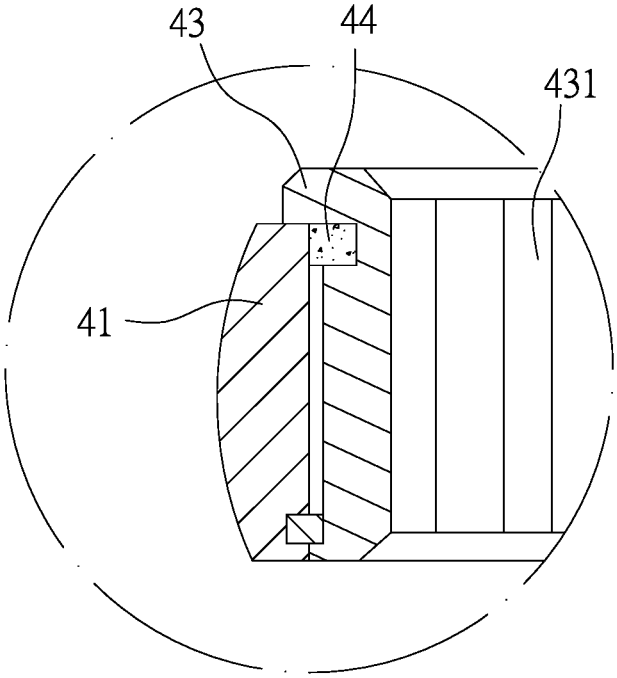
FIG. 12 PRIOR ART
FIG. 12 is a prior art.

Furthermore, in another embodiment, referring to FIGS. 8 and 9, an annular protruding portion (232) is extended from an end of the cover (23), and a surface of an outer periphery of the annular protruding portion (232) comprises a rough texture (233) thereon. The cover (23) is coupled on the outer end of the ratchet wheel (15) such that a user can rotate the ratchet wheel (15) by rotating the annular protruding portion (232). Moreover, the rough texture (233) is configured to enable the user to easily rotate the cover (23), so as to facilitate the operation of the main body (10).

Comparing with conventional ratchet wrench, the present invention is advantageous because: the main body (10) is cooperated with a quick release member (20) through the ratchet wheel (15), and the pressing member (22) of the quick release member (20) is adapted to move relative to the driving hole (154) and the magnetic ring (21), such that the sleeve (30) can be easily coupled in or detected from the driving hole (154) so as to achieve the quick release effect.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ratchet wrench comprising a main body and a quick release member;

wherein the main body has a driving end, and a tool hole vertically penetrates through the driving end; a housing concavely formed on an inner periphery of the tool hole is communicated with the tool hole, and a teeth section is installed in the housing; a ratchet wheel is rotated and driven into the tool hole through an inner end of the ratchet wheel, and an outer periphery of the ratchet wheel is adapted to engage with the teeth section of the tool hole so as to enable the ratchet wheel and the tool hole to have synchronous rotation; a driving hole axially penetrates through the ratchet wheel; and wherein the quick release member has a magnetic ring, a pressing member, and a cover; the magnetic ring is coupled and magnetically attached to an outer end of the ratchet wheel; the pressing member is a column having the outer diameter smaller than the inner diameter of the magnetic ring, and a locating flange formed at a middle portion of an outer periphery of the pressing member has the outer diameter larger than the inner diameter of the magnetic ring, and the pressing member comprises a first pressing section and a second pressing section respectively formed at two sides of the locating flange; the first pressing section is adapted to pass through a center hole of the magnetic ring and insert into the driving hole of the ratchet wheel, and the locating flange is abutted against an outer end of the magnetic ring, and the second pressing section is configured to protrude out of the ratchet wheel; the cover has a through hole penetrating through a center portion thereof, and the cover is disposed on the second pressing section through the through hole, and the cover is configured to cover the magnetic ring and the pressing member and coupled on the outer end of the ratchet wheel.

2. The ratchet wrench of claim 1, wherein a locating edge is formed at an inner edge of an inner opening of the tool hole while a first annular groove is formed at an inner edge of an outer opening of the tool hole; the inner end of the ratchet wheel has a locating recess which is configured to engage with the locating edge of the tool hole, and the outer end of the ratchet wheel comprises a second annular groove which is cooperated with a C-shaped ring to engage with the first annular groove.

3. The ratchet wrench of claim 1, wherein the teeth section is connected to a pulling member which is adapted to drive and move the teeth section in the housing so as to adjust the engagement between the teeth section and the ratchet wheel when the tool hole is rotated in clockwise direction or counterclockwise direction.

4. The ratchet wrench of claim 1, wherein a locating groove is formed at the outer end of the ratchet wheel, and the magnetic ring is positioned by engaging with the locating groove.

5. The ratchet wrench of claim 1, wherein the magnetic ring is fixed with the ratchet wheel by glue.

6. The ratchet wrench of claim 1, wherein the cover is fixed with the outer end of the ratchet wheel by glue.

7. The ratchet wrench of claim 1, wherein an annular protruding portion is extended from an end of the cover, and a surface of an outer periphery of the annular protruding portion comprises a rough texture thereon.

* * * * *